US006601596B2

(12) United States Patent
Liang et al.

(10) Patent No.: US 6,601,596 B2
(45) Date of Patent: Aug. 5, 2003

(54) APPARATUS FOR CLEANING A WAFER WITH SHEARING STRESS FROM SLAB WITH CURVED PORTION

(75) Inventors: Ming-Chung Liang, Pingtung (TW); Shin-Yi Tsai, Hsinchu (TW)

(73) Assignee: Macronix International Co., Ltd., Hsinchu (TW)

( * ) Notice: Subject to any disclaimer, the term of this patent is extended or adjusted under 35 U.S.C. 154(b) by 47 days.

(21) Appl. No.: 09/847,200

(22) Filed: May 2, 2001

(65) Prior Publication Data

US 2002/0134411 A1 Sep. 26, 2002

(30) Foreign Application Priority Data

Mar. 21, 2001 (TW) ..... 90106658 A

(51) Int. Cl.[7] ..... B08B 3/00

(52) U.S. Cl. ..... 134/153; 134/183; 15/77

(58) Field of Search ..... 134/153, 182, 134/183; 15/77

(56) References Cited

U.S. PATENT DOCUMENTS 5,947,134 A * 9/1999 Kim et al. ..... 134/57 R
6,273,104 B1 * 8/2001 Shinbara et al. ..... 134/25.4

* cited by examiner

*Primary Examiner*—Randy Gulakowski
*Assistant Examiner*—Joseph Perrin

(57) ABSTRACT

An apparatus for cleaning a semiconductor wafer is disclosed to substantially improve the efficiency of the cleaning process, and reduce the quantity of cleaning solvent used. The apparatus includes a rotating table for supporting the wafer, a rotation device to rotate the rotation table, a movable or stationary curved-slab for scrubbing the surface of the wafer efficiently, a cleaning nozzle for applying a cleaning solvent or stripper on the surface of the wafer, and a resistance wall for preventing the cleaning solvent spun out from the wafer to pollute the cleaning room.

10 Claims, 3 Drawing Sheets

APPARATUS FOR CLEANING A WAFER WITH SHEARING STRESS FROM SLAB WITH CURVED PORTION

FIELD OF THE INVENTION

The present invention relates to an apparatus for cleaning a wafer and, more particularly, to an apparatus that may improve the cleaning effect without increasing the amount of solvent used.

BACKGROUND OF THE INVENTION

As device density in a semiconductor ICs increases control over the semiconductor process conditions is increasingly crucial. In VLSI fabrication, the accurate control of layer thickness, reaction temperature, and pressure is more important for reducing defects in semiconductor ICs. Many materials that are used in semiconductor processes undergo, for example, etching, patterning, and planarization processes after the materials are formed on the semiconductor wafer. Before processes are carried out in a reaction chamber, the wafer will be sent to chemical stages for cleaning of the wafer. The unwanted particles will typically be removed from the wafer during these stages.

FIG. 1 shows, in schematic form, a conventional apparatus 10 for removing and cleaning unwanted particles formed on a semiconductor wafer's surface. The apparatus 10 is used during a cleaning step. The apparatus 10 includes a rotation table 12 for supporting a wafer 14, and a rotation device 16 to rotate the rotation table. A nozzle 18 is set at top of the wafer 14 to spray cleaning solvent on the surface of the wafer 14. A resistance wall 20 located surrounding the apparatus 10 is used to prevent the spun out cleaning solvent from polluting the cleaning room. A liquid outlet 22 is located at the bottom of the resistance wall 20 for draining the waste cleaning solvent out of the resistance wall 20.

During the cleaning step, the nozzle 18 sprays cleaning solvent on the surface of the wafer 14 to remove some of the unwanted particles generated on the wafer 14 during the semiconductor processes described above. At this time, the rotation device will rotate the rotation table 12 and wafer 14 according to the predetermined rotation velocity. The kind of rotation will generate centrifugal force to push the cleaning solvent sprayed on the wafer 14 to clean the wafer 14. After the cleaning step, the cleaning solvent will drain by opening the liquid outlet 22. However, because of only utilizing the centrifugal force to push the cleaning solvent away from the wafer to clean the wafer 14, the conventional cleaning apparatus 10 fails to remove a significant amount of the particles especially some particles adhering to the wafer surface tightly. However, the cleaning solvent will be spun out rapidly in the conventional cleaning apparatus 10, therefore, the cleaning solvent may not stay on the wafer for a long time, which may cause wasteful use of the cleaning agent.

SUMMARY OF THE INVENTION

In accordance with the background of the invention, the conventional cleaning method utilizing the centrifugal force to push the cleaning solvent away from the wafer in order to clean the wafer will create many drawbacks. Therefore, the present invention provides an apparatus for performing a wafer cleaning that substantially increases the efficiency of the chemical cleaning process without increasing the quantity of cleaning solvent, and reduces contamination to a clean room in fabricating VLSI circuits.

In one embodiment, the present invention includes a rotating table supporting the wafer, a rotation device to rotate the rotation table, a movable or stationary curved-slab for scrubbing the surface of the wafer efficiently, a cleaning nozzle for applying a cleaning solvent or stripper on the surface of the wafer, and a resistance wall for preventing the spun out cleaning solvent from polluting the cleaning room.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DESCRIPTION OF THE PREFERRED EMBODIMENT

Without limiting the spirit and scope of the present invention, the method proposed in the present invention is illustrated with one preferred embodiment about efficiently improving the way in which a wafer is cleaned. People who are knowledgeable about the embodiments, can apply the present invention on different cleaning wafer apparatuses to eliminate the possibility of not removing the particles on the wafer's surface due to only utilizing the centrifugal force to push the cleaning solvent away from the wafer after cleaning the wafer. The cleaning apparatus of the present invention also may eliminate the disadvantage of wasting cleaning solvent. The usage of the present invention should not be limited by the following embodiments.

This cleaning apparatus according to the present invention primarily includes two parts. The first part of this cleaning apparatus utilizes the centrifugal force to push the cleaning solvent away from the wafer to remove particles on the wafer's surface. The second part is a curved-slab, wherein the shearing stress generated by "slab" can enhance cleaning efficiency. The stripper or cleaning solvent can also be collected by curved-slab, not spun out rapidly.

Figure 1:
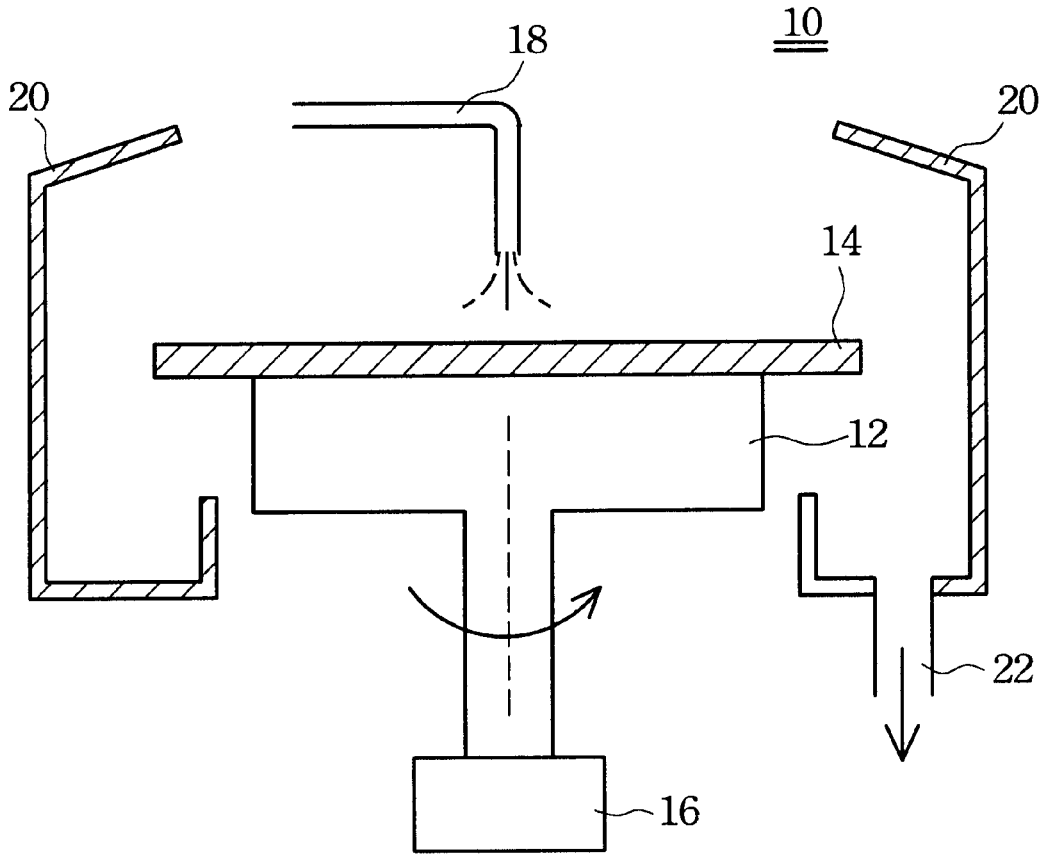
Fig. 1 (Prior art)
FIG. 1 is a schematic diagram of a prior art apparatus used for cleaning a semiconductor wafer.
Figure 2:
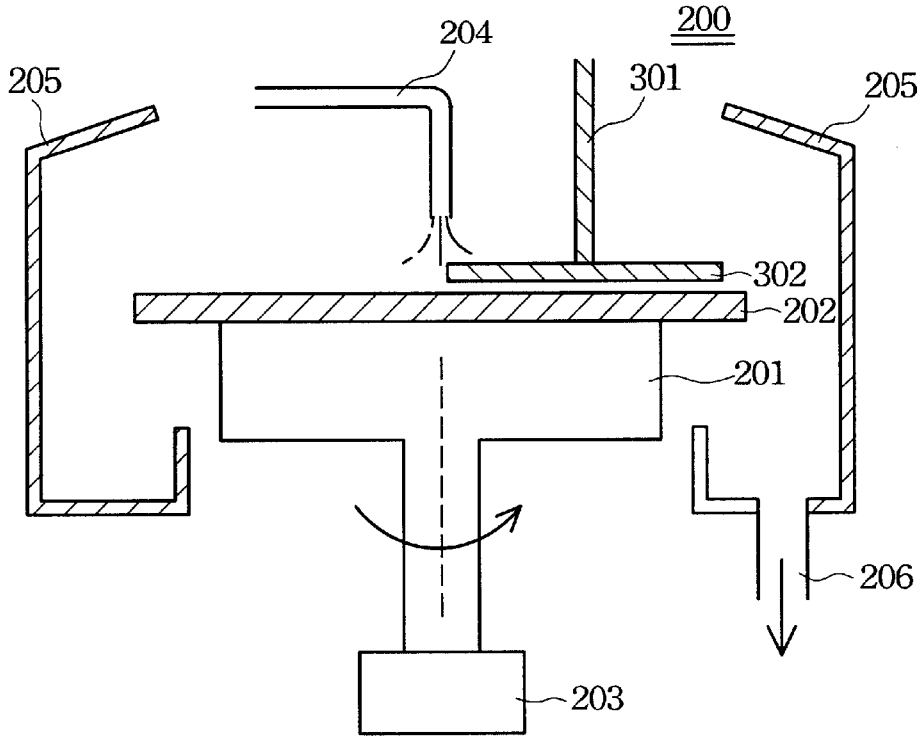
FIG. 2 is a cross-sectional view of an apparatus used for cleaning a semiconductor wafer in accordance with the present invention.
Figure 3:
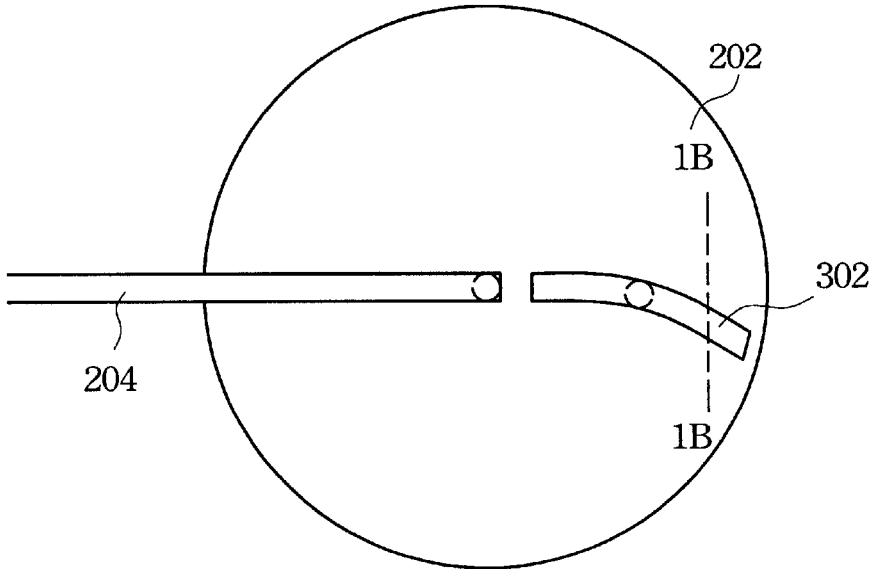
FIG. 3 shows a top view of the present invention's cleaning apparatus of FIG. 2.

FIG. 2 shows a cross-sectional view of an apparatus 200 for cleaning a semiconductor wafer. The cleaning wafer apparatus 200 includes a rotation portion and a curved-slab portion. The rotation portion further includes a rotating table 201, a wafer 202 disposed on the rotating table 201, a rotation device 203 to drive the rotation table 201 and a nozzle 204 connected to the cleaning solvent or stripper outlets (not shown in the figure) and has been set at the top of the wafer 202 to spray cleaning solvent or stripper on the surface of the wafer 202. The curved-slab portion further includes a holder 301 that is moveable or stationary to support a curved-slab 302 and a resistance wall 205 located surrounding the rotation portion and the curved-slab portion 10 to resist the spun out cleaning solvent that pollutes the cleaning room during the cleaning process. A liquid outlet 206 is used to drain the waste cleaning solvent. A simplified top view of the present invention's cleaning apparatus 200 is shown in FIG. 3, wherein only the wafer 202, the nozzle 204 and the curved-slab 302 are shown for conciseness.

In this embodiment, the curved-slab 302, the nozzle 204, and a rotating wafer 202 deposited on the rotation table 201 are preferably used to remove unwanted fragments generated during the different processes. The cleaning nozzle 204 is set on top of the wafer 202 during the cleaning process. In accordance with the preferred embodiment, the rotation device 203 will rotate the rotation table 12 and wafer 14 when the cleaning process starts. Next, the curved-slab 302 is guided over the wafer 202, and the cleaning nozzle 204 may spray cleaning solvent or stripper on the surface of the wafer 202. The nozzle 204 is used to spray deionized (DI) water or chemical solution, such as surfactant, hot alkaline or acidic hydrogen peroxide ($H_2O_2$) that chemically interacts with the surface of the wafer 202, in order to achieve better cleanliness and less surface damage.

Figure 4:
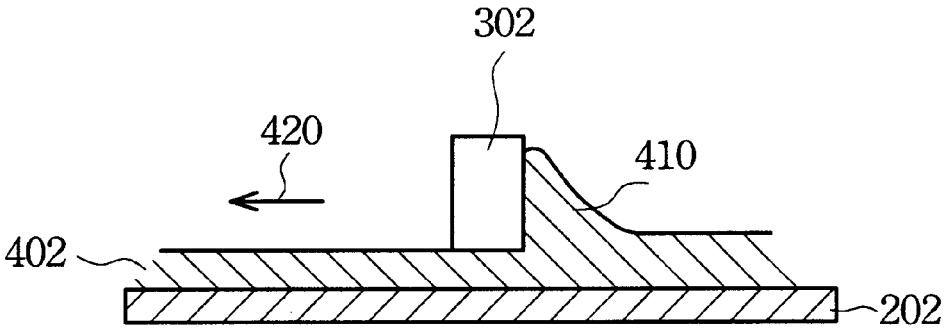
FIG. 4 shows a cross-sectional view from 1B—1B line of FIG. 3.

Specifically, in the arrangement of this embodiment, the curved-slab 302, which is moveable or stationary, is guided near the surface of the wafer 202. FIG. 4 is a cross-sectional view from 1B—1B line in FIG. 3. The wafer 202 is moved in the specified direction according to the arrow 420. And, the curved-slab 302 is set at the top of the wafer 202 which can collect the stripper or cleaning solvent 410. In accordance the present invention, when the rotation table is rotated, the curved-slab 302 will apply a shearing stress on the wafer 202 because of the relative motion between the curved-slab 302 and the wafer 202, which will make the fluid direction of the cleaning solvent or stripper in the features (line, hole or trench) of the wafer change. The shearing stress on the wafer 202 may eliminate the possibility of failing to remove the particles on the wafer surface due to only utilizing the centrifugal force to push the cleaning solvent away from the wafer to clean the wafer according to the conventional cleaning apparatus. On the other hand, the cleaning solvent will be spun out rapidly in the conventional cleaning apparatus, therefore, the cleaning solvent may not stop on the wafer for a long time, which may result in wasting cleaning solvent. However, in accordance with the present invention the cleaning solvent 410 may be collected by the curved-slab 302, not spun out rapidly, which may increase the time that the cleaning solvent stays on the wafer. In short, the curved-slab 302 will apply a shearing stress on the wafer 202 because of the relative motion between the curved-slab 302 and the wafer 202 during the cleaning process, which will make fluid direction of the cleaning solvent 401 not only in the direction of centrifugal force,but also in the shearing direction of stress. Moreover, the curved-slab may increase the time of the cleaning solvent stop on the wafer 202. Therefore, the present invention may improve the cleaning efficiency.

Figure 5:
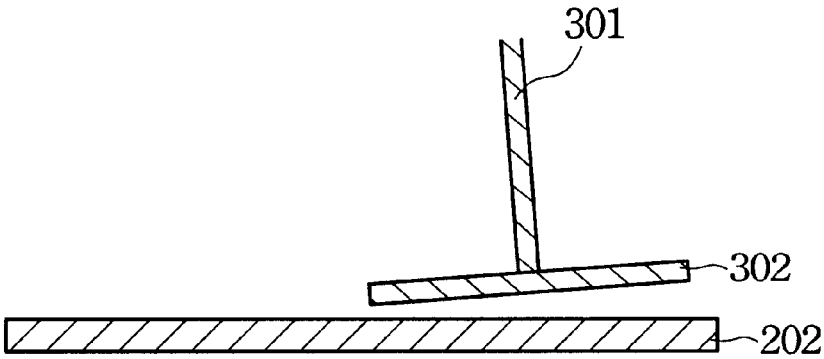
FIG. 5 is a cross-sectional view of an apparatus used for cleaning a semiconductor wafer in accordance with the present invention.

FIG. 5 illustrates the distance relationship between curved-slab 302 and wafer 202, wherein the distance can be modulated according to the angular velocity of the wafer. For example, the distance between the curved-slab 302 and the wafer 202 may be raised when the angle velocity increases. Therefore, an inclination angle will exist between the curved-slab 302 and the wafer 202 because the angle velocity of the wafer's edge is larger than the wafer's center. However, the curve of the curved-slab also can be modulated according to the preferred amount of cleaning solvent to be collected.

Although specific embodiments have been illustrated and described, it will be obvious to those skilled in the art that various modifications may be made without departing from the spirit which is intended to be limited solely by the appended claims.

What is claimed is:

1. An apparatus for cleaning a semiconductor wafer, said apparatus comprising:

a table for supporting the wafer;

a rotation device connected with said table for rotating said table to an specific angular velocity;

at least a cleaning head placed above said wafer for spraying cleaning solvent on the surface of said wafer; and a slab with a curved portion radially extending from the wafer center outward for resisting said cleaning solvent directly spun out said wafer, wherein said slab being set above said wafer a distance to provide shearing stress on said wafer for cleaning said wafer, and said distance related to said specific angular velocity.

2. The apparatus according to claim 1, wherein said slab is stationary.

3. The apparatus according to claim 1, wherein said slab is moveable.

4. The apparatus according to claim 1, wherein said cleaning solvent is a chemical solvent.

5. The apparatus according to claim 1, wherein said cleaning solvent is deionized (DI) water.

6. An apparatus for cleaning a semiconductor wafer, said apparatus comprising:

a table for supporting the wafer;

a rotation device connected with said table for rotating said table to an specific angular velocity;

at least a cleaning head placed above said wafer for spraying cleaning solvent on the surface of said water; and a slab with a curved portion radially extending from the wafer center outward for resisting said cleaning solvent directly spun out said wafer, wherein said slab being placed above said wafer with a tilt angle defined as an inclination angle and said tilted slab may provide shearing stress on said wafer for cleaning said wafer and said tilt angle related to said angular velocity.

7. The apparatus according to said claim 6, wherein said slab is stationary.

8. The apparatus according to claim 6, wherein said slab is moveable.

9. The apparatus according to claim 6, wherein said cleaning solvent is a chemical solvent.

10. The apparatus according to claim 6, wherein said cleaning solvent is deionized (DI) water.

* * * * *